US010826228B2

(12) United States Patent
Lee et al.

(10) Patent No.: US 10,826,228 B2
(45) Date of Patent: Nov. 3, 2020

(54) CONNECTOR

(71) Applicant: LG INNOTEK CO., LTD., Seoul (KR)

(72) Inventors: Byong Ho Lee, Seoul (KR); Dong Joon Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 16/469,215

(22) PCT Filed: Jan. 10, 2018

(86) PCT No.: PCT/KR2018/000453
§ 371 (c)(1),
(2) Date: Jun. 13, 2019

(87) PCT Pub. No.: WO2018/131878
PCT Pub. Date: Jul. 19, 2018

(65) Prior Publication Data

US 2020/0106211 A1 Apr. 2, 2020

(30) Foreign Application Priority Data

Jan. 11, 2017 (KR) ..... 10-2017-0004208
Jan. 18, 2017 (KR) ..... 10-2017-0008536

(51) Int. Cl.
*H01R 13/533* (2006.01)
*H01R 13/405* (2006.01)
*H01R 13/502* (2006.01)

(52) U.S. Cl.
CPC ..... *H01R 13/533* (2013.01); *H01R 13/405* (2013.01); *H01R 13/5025* (2013.01)

(58) Field of Classification Search
CPC . H01R 13/533; H01R 13/5025; H01R 13/405
See application file for complete search history.

(56) References Cited

U.S. PATENT DOCUMENTS 8,979,554 B2 * 3/2015 Yudate ..... H01R 13/5202 439/76.1
9,065,194 B2 * 6/2015 Suzuki ..... H01R 4/34
(Continued)

FOREIGN PATENT DOCUMENTS

CN 102257681 A 11/2011
CN 102263344 A 11/2011
(Continued)

OTHER PUBLICATIONS

International Search Report (with English Translation) and Written Opinion dated Apr. 17, 2018 issued in Application No. PCT/KR2018/000453.
(Continued)

*Primary Examiner* — Xuong M Chung Trans
(74) *Attorney, Agent, or Firm* — Ked & Associates LLP

(57) ABSTRACT

The present invention relates to a connector which is disposed outside a case, the connector comprising: a terminal protruding at one end thereof into the case and protruding at the other end thereof out of the case; an inner housing coupled to the terminal so as to allow the terminal to protrude at the one end and the other end thereof; a pad disposed on one surface of the inner housing; and a housing completely surrounding the inner housing and the pad, wherein the housing comprises: a protrusion portion protruding from one surface of the case; and a mounting portion having a terminal groove in which the other protruding end of the terminal is placed.

20 Claims, 9 Drawing Sheets

(56) References Cited

U.S. PATENT DOCUMENTS

| | | | | |
|---|---|---|---|---|
| 9,099,815 | B2 * | 8/2015 | Kashiwada | H01R 12/00 |
| 2011/0287658 | A1 | 11/2011 | Yu et al. | |
| 2012/0015537 | A1 | 1/2012 | Park | |
| 2012/0015549 | A1 | 1/2012 | Youn et al. | |
| 2012/0181317 | A1 * | 7/2012 | Evens | G06F 1/1626 224/576 |

FOREIGN PATENT DOCUMENTS

| | | |
|---|---|---|
| JP | 2011-044302 | 3/2011 |
| JP | 2012-221908 | 11/2012 |
| JP | 2015-005431 | 1/2015 |
| KR | 10-2010-0090118 | 8/2010 |

OTHER PUBLICATIONS

Chinese Office Action dated Apr. 3, 2020 issued in Application 201880006622.1.

* cited by examiner

CONNECTOR

CROSS-REFERENCE TO RELATED PATENT APPLICATIONS

This application is a U.S. National Stage Application under 35 U.S.C. § 371 of PCT Application No. PCT/KR2018/000453, filed Jan. 10, 2018, which claims priority to Korean Patent Application No. 10-2017-0004208, filed Jan. 11, 2017, and Korean Patent Application No. 10-2017-0008536, filed Jan. 18, 2017, whose entire disclosures are hereby incorporated by reference.

TECHNICAL FIELD

The present invention relates to a connector.

BACKGROUND ART

Electrical component, for example, a clutch actuator controlling the clutch is provided with a control module which controls the operation of a motor or a solenoid. The control module operates the motor or the solenoid according to the control command of the control unit, thereby shifting gear.

The control module comprises a printed circuit board on which a plurality of electronic components are mounted, and is disposed inside the housing. At this time, the housing may be provided with a connector for electrical connection between the control module and other components.

FIG. 1 is a perspective view showing a part of an electrical component according to the prior art.

Referring to FIG. 1, external shape of an electrical component 1 according to the prior art is formed by a housing 2. Various electronic components comprising a printed circuit board are disposed inside the housing 2. A connector 4 wherein a mounting groove 5 is formed is provided on the outer surface of the housing 2. As for an example of the above mentioned electrical components, a terminal (not shown) which is electrically connected to the printed circuit board, is disposed on the bottom surface of the mounting groove 5 and may be exposed to the outside of the housing 2. Therefore, a device with a separate plug is inserted into the mounting groove 5, so that when the plug and the terminal are electrically contacted, power can be supplied to the electronic parts or a control command necessary for driving can be transmitted and received.

As described above, various electronic components comprising a printed circuit board are disposed inside the housing 2. The electronic components generate heat in accordance with driving, and gas or liquid may be generated in the housing 2 due to the generated heat. Therefore, a discharge port 6 for discharging heat, gas or liquid to the outside is formed on the outer surface of the housing 2.

The discharge port 6 is formed in an area of the outer surface of the housing 2 corresponding to an arrangement area of the electronic component. At this time, the discharge port 6 is formed as a hole penetrating the outer surface of the housing 2 from the inner surface thereof, and it may be configured to have a separate shielding film to cover the hole. The shielding film prevents moisture or dust from flowing into the housing 2 and discharges heat or gas existing inside the housing 2 to the outside.

According to the above configuration, since the discharge port 6 for discharging heat or gas exists separately in the housing 2, there is a problem that the manufacturing process is complicated and the manufacturing cost is increased. In addition, since various components comprising the connector 4 are disposed in the housing 2 in addition to the discharge port 6, there is a space limit in the arrangement of the respective components in view of the recent trend of downsizing the product.

On the other hand, the material of the housing in which the connector is formed is generally made of synthetic resin or plastic in consideration of the manufacturing cost and weight of the product. The terminal is connected to the printed circuit board at one end, and the other end is exposed to the outside through the bottom surface, so that the bonding between the housing and the terminal is essential.

However, considering the coefficient of thermal expansion and the low adhesive force between the metal and the plastic, the plastic housing and the metal terminal have a disadvantage in that the mutual bonding strength is low. Particularly, the housing is generally manufactured by molding in a state where terminals are disposed, and a gap may be formed between the housing and the terminal due to heat generated at this time. Because of this, a tolerance may be generated between the actual position of the terminal and the original design region, and as a result, there is a problem in that the quality and reliability of the product may be deteriorated.

DETAILED DESCRIPTION OF THE INVENTION

Technical Subject

The present invention has been proposed in order to solve the above-mentioned problems, and an objective of the present invention is to provide a connector capable of reducing the manufacturing cost as the number of parts is reduced.

Another object of the present invention is to provide a connector capable of enhancing a coupling force between a terminal and a housing.

Technical Solution

As for an exemplary embodiment, in a connector which is disposed outside a case, the connector comprises: a terminal protruding at one end thereof into the case and protruding at the other end thereof out of the case; an inner housing coupled to the terminal so as to allow the terminal to protrude at the one end and the other end thereof; a pad disposed on one surface of the inner housing; and a housing completely surrounding the inner housing and the pad, wherein the housing comprises: a protrusion portion protruding from one surface of the case; and a mounting portion having a terminal groove in which the other protruding end of the terminal is placed.

The material of the pad may be an elastically deformable material.

A pad seating portion for seating the pad may be provided in a front surface of the inner housing wherein a portion of the front surface is recessed rearward to be stepped with respect to the other area.

The width of the pad seating portion may be corresponding to the width of the pad.

A separate pad may be coupled to the lower surface of the inner housing.

The inner housing and the housing may be formed by separate injection molding processes.

The inner housing coupled with the terminal may be formed by a first injection molding process, and the housing may be formed by a second injection molding process with the pad being coupled to the inner housing.

As for another exemplary embodiment, in a connector which is disposed outside a case, the connector comprises: a terminal having one end protruded towards the inside of the case and the other end protruded towards the outside of the case; an inner housing coupled to the terminal in a way that one end and the other end of the terminal are protruded; a pad disposed on one surface of the inner housing; and a housing surrounding the inner housing and the pad, wherein the housing comprises: a protrusion portion protruding from one surface of the case; and a mounting portion formed with a terminal groove wherein the other end of the terminal being protruded is disposed, and the housing may comprise a discharge pipe communicating the inside and the outside of the case.

A discharge flow path of hollow shape may be formed inside of the discharge pipe.

A discharge hole communicating with the discharge path may be formed on the bottom surface of the terminal groove.

A shielding film covering the discharge hole may be further included.

The discharge pipe may comprise: a first discharge pipe extending upward from a lower surface of the case and disposed inside the protrusion portion; and a second discharge pipe extending from a bottom surface of the terminal groove and communicating with the first discharge pipe.

The first discharge pipe and the second discharge pipe may be disposed perpendicular to each other.

The second discharge pipe may be connected to a side surface which is a region between an upper end and a lower end of the first discharge pipe.

The protrusion portion and the mounting portion may comprise a hollow in which the terminal is disposed.

The terminal may comprise a power supply terminal for supplying power to the electronic component and a signal supply terminal for transmitting and receiving a signal of the electronic component, wherein the bottom surface may be disposed with a partition wall that separates the power supply terminal from the signal terminal.

Advantageous Effects

According to the present invention, there is an advantage in that since there is no need for a separate structure for discharging heat or fluid to the outer surface of the case, the number of components is reduced and the manufacturing cost is lowered.

In addition, there is an advantage in that a free space for disposing separate parts on the outer surface of the case is provided, and the degree of freedom of design is increased.

Further, since the pad tightly surrounds the terminal even in a high-temperature and high-pressure injection molding process, there is an advantage in that the bonding force between the terminal and the housing can be enhanced.

BEST MODE

Figure 1:
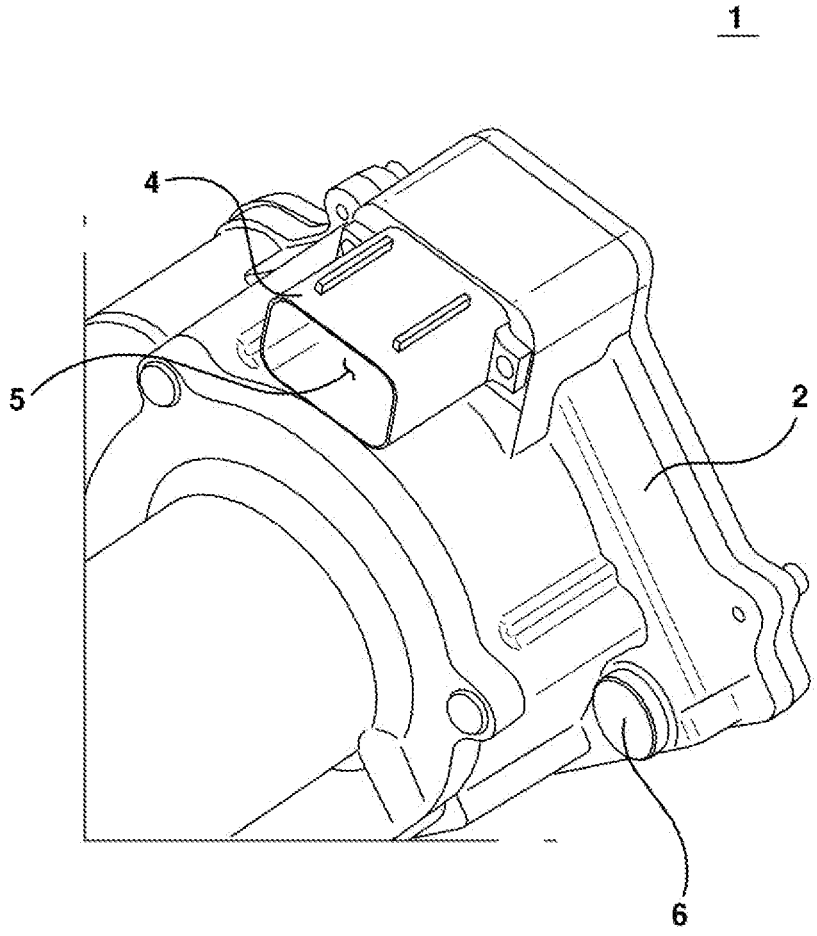
FIG. 1 is a perspective view showing a part of an electrical component according to the prior art.

Since the present invention, which will be described hereinafter, may apply to various modifications and may have various exemplary embodiments, some specific exemplary embodiments are illustrated in the drawings and will be described in detail in the detailed description.

This, however, is by no means to restrict the invention to the specific embodiments, it is to be understood as embracing all modifications, equivalents and substitutes included in the spirit and scope of the present invention. If the specific description of the related art in the following description of the present invention that are determined to obscure the gist of the invention, the detailed description thereof is omitted.

The terms used in the present specification are merely used to describe particular exemplary embodiments, and are not intended to limit the present invention. Expressions in singular forms include plural forms unless the context clearly indicates otherwise. In this application, the terms "comprise," "have," and the like are intended to specify the features, numbers, steps, actions, components, parts, or one that exists combinations thereof described in the specification, but are not intended to preclude the one or more other features, numbers, steps, actions, components, parts, or the presence or possibility of combinations thereof.

Further, terms such as "first", "second" may be used to separately describe various elements, but the above elements shall not be restricted to the above terms. These terms are only used to distinguish one element from the other.

In this specification, a connector is disposed on an outer surface of a case having a plurality of parts therein, and comprises a terminal for being electrically connected to at least one of the plurality of parts. It will therefore be readily apparent to those skilled in the art that the configuration according to the embodiments described herein may be applied to various devices having terminals.

Figure 2:
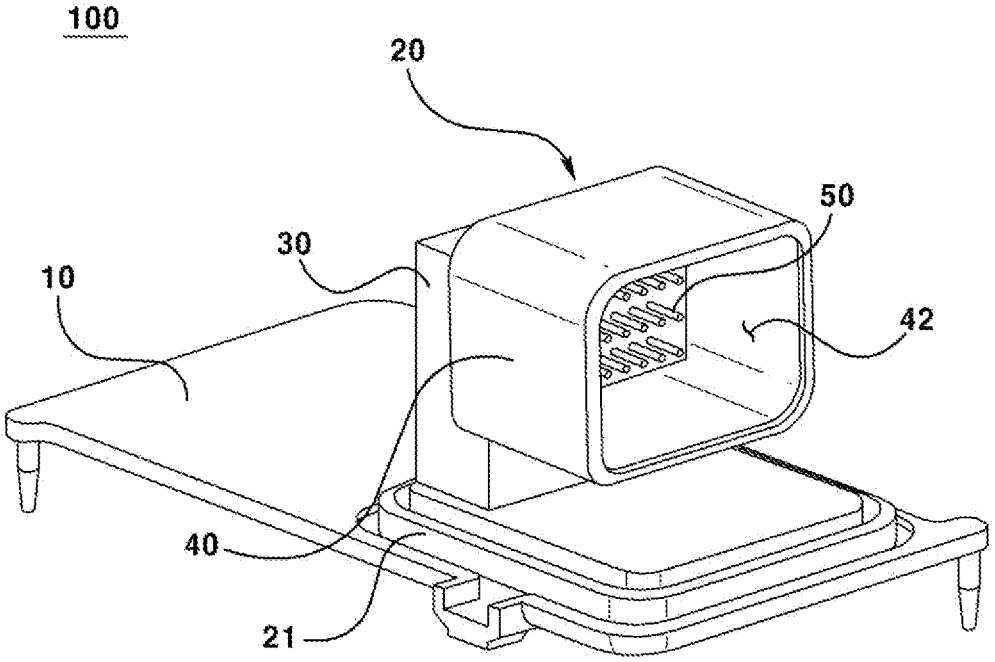
FIG. 2 is a perspective view of a connector according to a first embodiment of the present invention.
Figure 3:
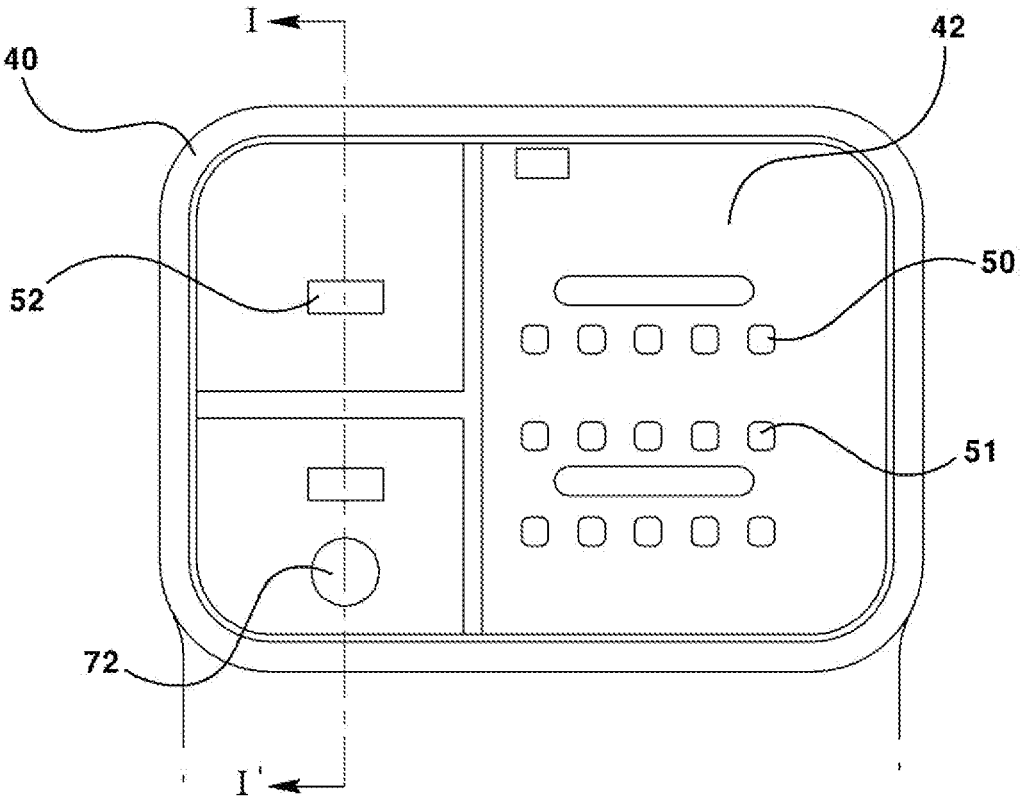
FIG. 3 is a front view of the connector of FIG. 2 viewed from the terminal groove.
Figure 4:
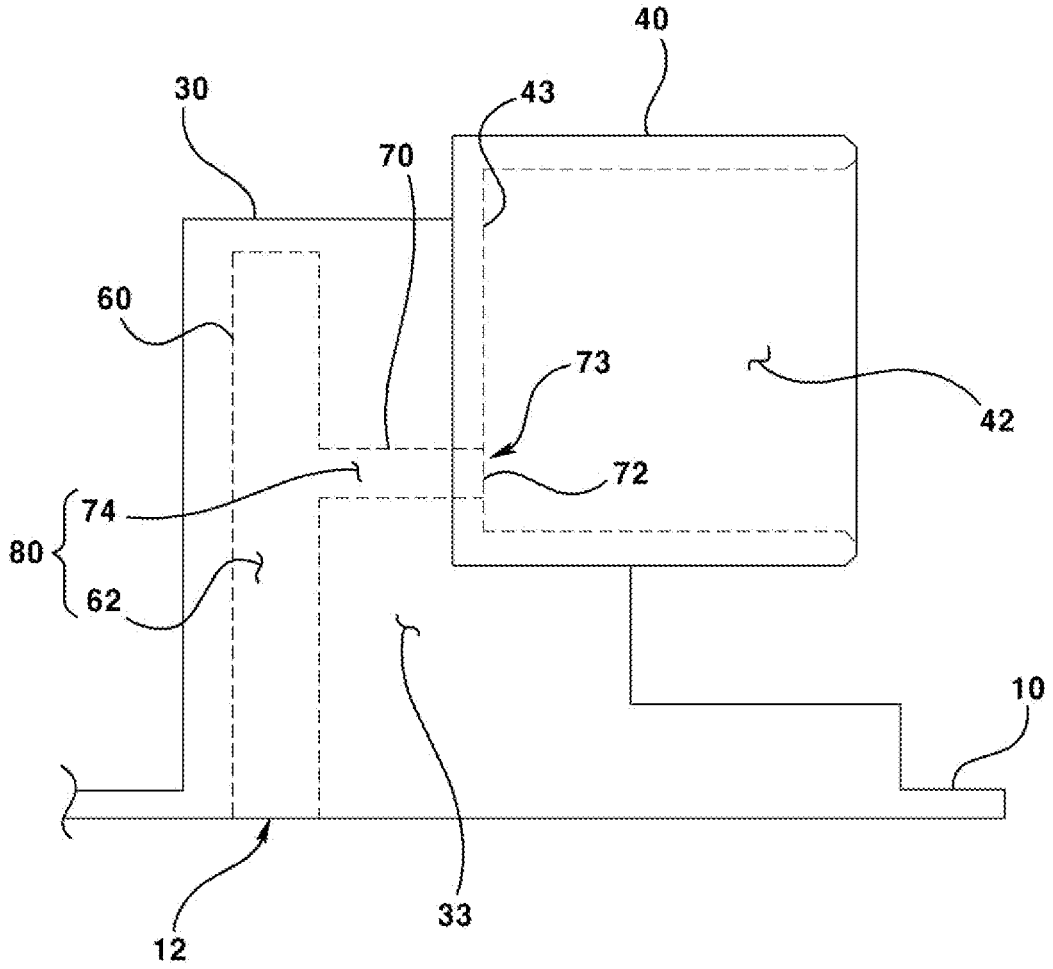
FIG. 4 is a cross-sectional view taken along the line I-I' of FIG. 3.

FIG. 2 is a perspective view of a connector according to a first embodiment of the present invention; FIG. 3 is a front view of the connector of FIG. 2 viewed from the terminal groove; and FIG. 4 is a cross-sectional view taken along line I-I' of FIG. 3.

Referring to FIGS. 2 and 3, a connector 100 according to a first embodiment of the present invention comprises a housing 20 and a terminal 50 disposed in the housing 20.

The housing 20 is formed on an outer surface of a case 10 in which various electronic components (not shown) are disposed. In other words, it can be understood that the housing 20 is provided on the outer surface of the case 10, which is an external shape of the electrical component.

In detail, the housing 20 comprises a protrusion portion 30 protruding from the outer surface of the case 10 and a mounting portion 40 extending from one surface of the protrusion portion 30 to form a terminal groove 42. A hollow is formed in the housing 20 so that the terminal 50 is disposed.

Electronic components (not shown) electrically connected to the terminals 50 are disposed inside the case 10. For example, the electronic component may be a printed circuit board that transmits and receives a control command. Accordingly, the terminal 50 may be connected to the printed circuit board at one end thereof and may be exposed to the outside through the mounting groove 42 of the mounting portion 40 at the other end. A hole (not shown) may be formed in the case 10 to allow the terminal 50 to pass therethrough.

The case 10 may be formed integrally with the housing 20. For example, the electronic component may be disposed inside a separate case, and the housing 20 of the connector 100 comprising the case 10 may be mounted in the separate case. In this case, a mounting hole for mounting the connector 100 may be formed in the separate case.

The protrusion portion 30 is extended upward from the upper surface of the case 10. A hollow is formed in the protrusion portion 30 so that the terminal 50 is disposed. A step portion 21 which upwardly separates the housing 20 so that a separate plug (not shown) which is coupled to the mounting groove 42 of the connector 100 is easily coupled.

The mounting portion 40 is formed on the front surface of the protrusion portion 30. When the surface on which the mounting portion 40 is formed is referred to as a front surface, the front surface of the mounting portion 40 is formed with a terminal groove 42 which is recessed towards the rear so that the terminal 50 is exposed to the outside. Therefore, it is understood that the hollow formed inside the housing 20 is extended upward from the upper surface of the case 10 and communicates with the terminal groove 42.

Meanwhile, the material of the case 10 and the housing 20 may be any one of plastic and resin.

One end of the terminal 50 is electrically connected to the electronic component and the other end is exposed to the outside through the mounting groove 42. That is, the other end of the terminal 50 is protruded from the bottom surface 43 (refer to FIG. 4) of the mounting groove 42 and is exposed to the outside. A separate plug which is in electrical contact with the terminal 50 is inserted into the mounting groove 42 so that power is supplied to the electronic component through electrical contact with the terminal 50 or a separate signal may be transmitted or received.

The terminal 50 may be bent at least once. Since the mounting portion 40 is extended forward from the front surface of the protrusion portion 30, the terminal 50 can also be bent forward at a vertical end extending from the electronic component.

The plurality of terminals 50 may be provided. For example, the terminal 50 may comprise a power supply terminal 52 for supplying power to the electronic components, and a signal terminal 51 for transmitting and receiving signals to and from the electronic components. The power terminal 52 and the signal terminal 51 are spaced apart from each other and may be divided at the bottom surface 43 of the mounting groove 42. Further, a partition wall separating the power terminal 52 from the signal terminal 51 may be disposed in the mounting groove 42.

Hereinafter, the discharging structure which is an essential part of the present invention will be described.

Referring to FIGS. 2 and 3, a discharge flow path 80 is formed in the connector 100 according to the first embodiment of the present invention. The discharge flow path 80 is extended from the bottom surface 43 of the mounting groove 42 to the inside of the case 10 so that the inside and the outside of the case 10 communicate with each other. Heat or fluid generated in the case 10 is discharged to the outside through the discharge flow path 80.

The discharge flow path 80 comprises a first discharge flow path 62 extending from the outer surface of the case 10 towards the inner space of the protrusion portion 30 and a second discharge flow path 74 extending from the bottom surface 43 of the mounting groove 42 to the first discharge flow path 62 so as to be communicating with the first discharge flow path 62. It can be understood that the internal space of the electrical component, that is, the inside of the case 10, and the outside are communicating with each other through the discharge flow path 80.

The first discharge flow path 62 may be formed inside the first discharge pipe 60. The first discharge pipe 60 may extend upward from the lower surface of the case 10 and be disposed inside the protrusion portion 30. In this case, in order to communicate with the inside of the case 10, a communicating hole 12 may be formed in a region of the case 10 to which the lower end of the first discharge pipe 60 is coupled. The upper end of the first discharge pipe 60 extending upward may be disposed adjacent to the upper side of the protrusion portion 30.

The second discharge flow path 70 may be formed inside the second discharge pipe 70. The second discharge pipe 70 is extended rearward from the bottom surface 43 and is coupled to one side of the first discharge pipe 60. The first discharge pipe 60 and the second discharge pipe 70 may be disposed perpendicular to each other.

At this time, the first discharge pipe 60 and the second discharge pipe 70 are coupled so that the first discharge flow path 62 and the second discharge flow path 74 are in communication with each other. To this end, a communication hole (not shown) may be formed on the outer surface of the first discharge pipe 60 so that the second discharge pipe 70 may be coupled to the communication hole. Alternatively, the first discharge pipe 60 and the second discharge pipe 70 may be integrally formed.

The second discharge pipe 70 is disposed in a region between the upper end and the lower end of the first discharge pipe 60. That is, when the first discharge pipe 60 is divided into the upper part and the lower part based on the area where the second discharge pipe 70 is coupled, the upper part of the first discharge pipe 60 The first discharge flow path 62 can be formed wider. Therefore, the heat generated from the inside of the case 10 can be discharged to the outside of the case 10 more efficiently.

A shielding film 72 is provided in the discharge hole 73 formed at the outlet of the second discharge flow path 70, that is, the bottom surface 43 of the terminal groove 42, based on the flow of heat and fluid. The discharge hole 73 can communicate with the discharge flow path 80.

The shielding film 72 covers the discharge hole 73 to prevent moisture or dust from entering the interior of the housing 20. That is, the shielding film 72 passes the heat or fluid discharged from the second discharge channel 70 to the outside, and prevents moisture or dust existing in the outside from flowing into the inside of the housing 20.

Accordingly, the heat or gas generated in the electronic component (printed circuit board) which may be provided on the lower side of the case 10 with reference to inside the case 10, that is, FIG. 4, can be discharged to outside through the discharge flow path.

According to the connector 100 of the above configuration, since a separate structure for discharging heat or fluid is not required on the outer surface of the case 10, there is an advantage that the number of parts is reduced and the manufacturing cost is lowered.

In addition, there is an advantage in that a free space for disposing separate parts on the outer surface of the case is provided, and the degree of freedom of design is increased.

In this embodiment, the first discharge flow path 62 and the second discharge flow path 74 are disposed inside the first discharge pipe 60 and the second discharge pipe 70, respectively, however, only the discharge flow paths 62 and 74 may be formed in the protrusion portion 30 except for the first discharge pipe 60 and the second discharge pipe 70.

Hereinafter, a connector according to a second embodiment of the present invention will be described.

Figure 5:
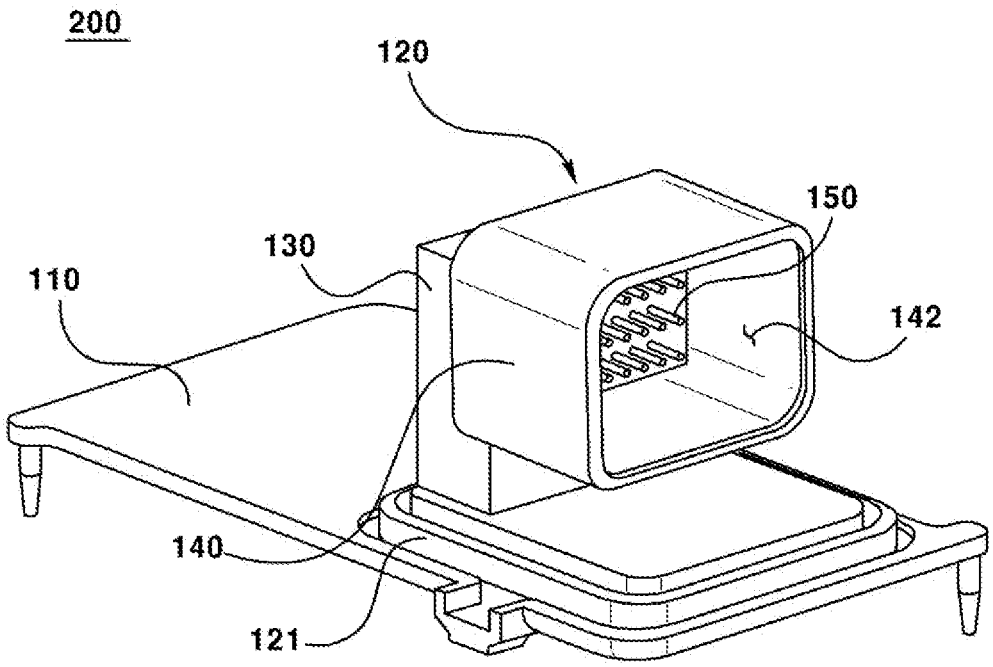
FIG. 5 is a perspective view of a connector according to a second embodiment of the present invention.
Figure 6:
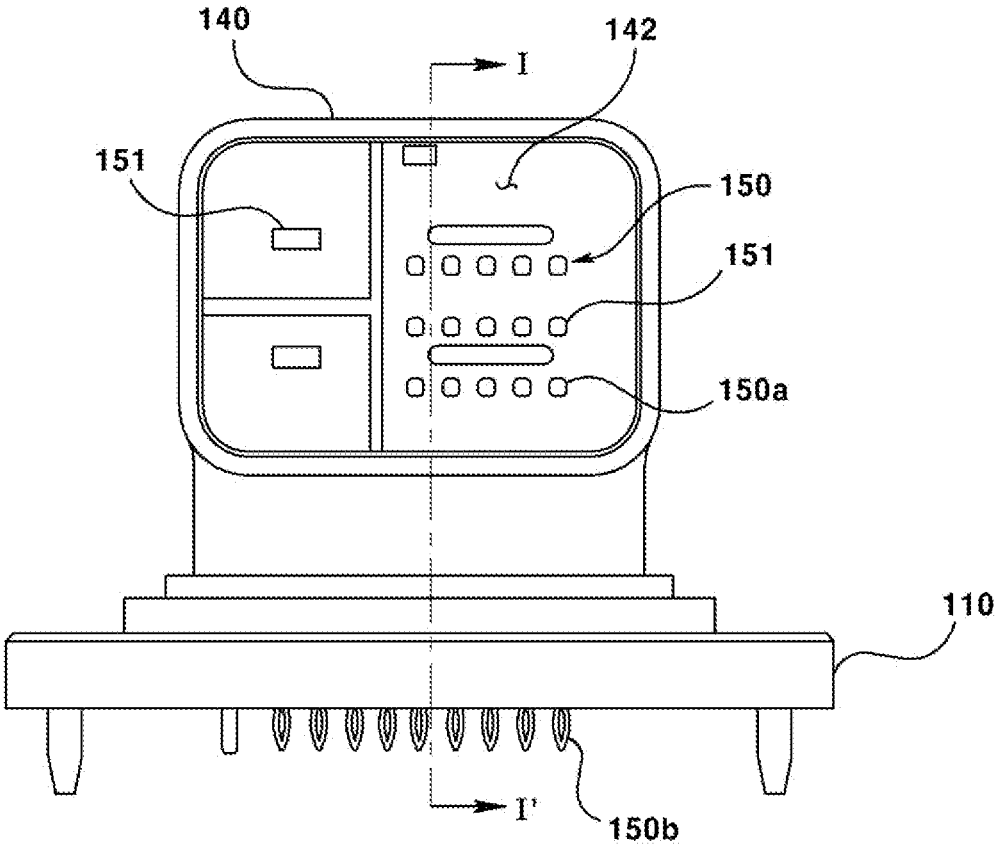
FIG. 6 is a cross-sectional view of the connector of FIG. 1 viewed from the terminal groove.

FIG. 5 is a perspective view of a connector according to a second embodiment of the present invention; FIG. 6 is a cross-sectional view of the connector of FIG. 1 viewed from the terminal groove; and FIG. 7 is a cross-sectional view taken along the line I-I' of FIG. 6.

Figure 7:
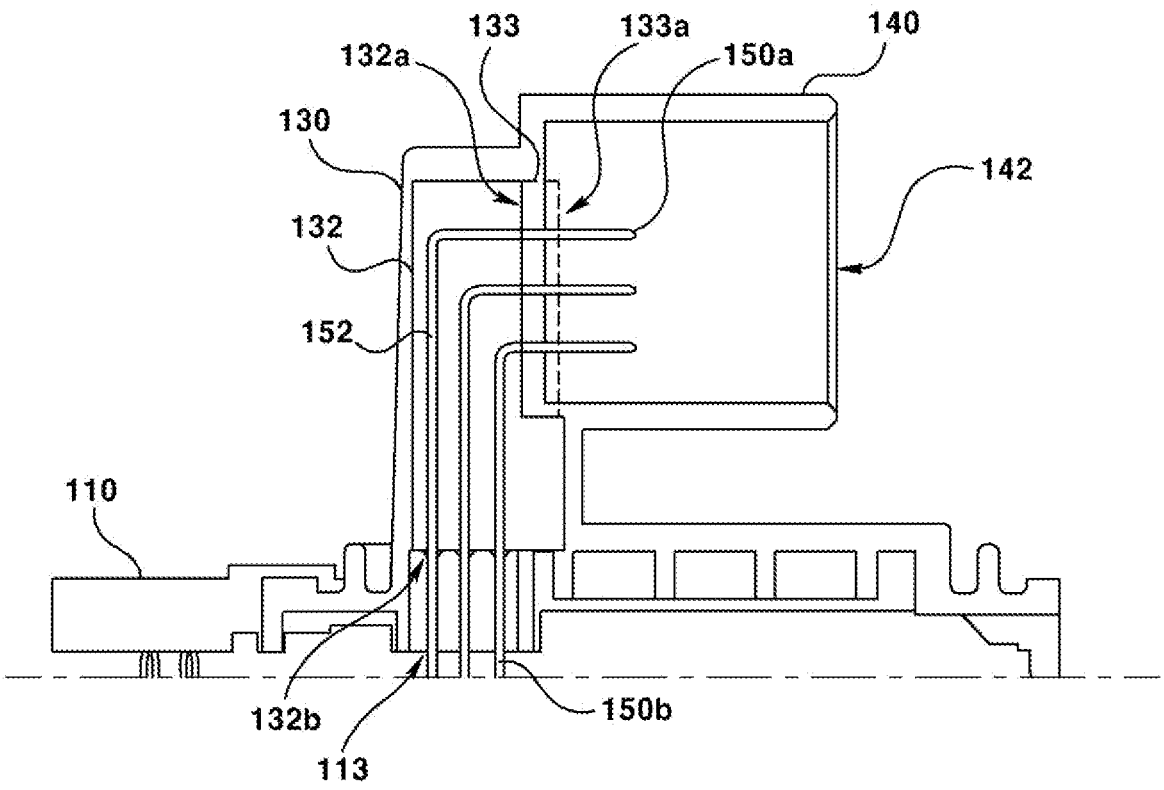
FIG. 7 is a cross-sectional view taken along line I-I' of FIG. 6.

Referring to FIGS. 5 to 7, the connector 200 according to the second embodiment of the present invention comprises a housing 120 and a terminal 150 disposed in the housing 120.

The housing 120 is formed on an outer surface of a case 110 in which various electronic components (not shown) are disposed. Particularly, the housing 120 comprises a protrusion portion 130 protruding from the outer surface of the case 110 and a mounting portion 140 extending from one surface of the protrusion portion 130 and having a terminal groove 142 formed on the outer surface thereof. And a hollow is formed inside the housing 120 so that the terminal 150 is disposed.

Electronic components (not shown) electrically connected to the terminals 150 are disposed in the case 110. For example, the electronic component may be a printed circuit board that transmits and receives various control commands. Therefore, one end of the terminal 150 may be electrically connected to the printed circuit board, and the other end may be exposed to the outside through the mounting groove 142 of the mounting portion 140. The case 110 may have a hole 113 through which the terminal 150 passes.

Alternatively, the case 110 may be formed integrally with the housing 120. For example, the electronic component may be disposed inside a separate case, and the housing 120 of the connector 200 comprising the case 110 may be mounted in the separate case. For this purpose, the separate case may be formed with a hole for coupling the connector 200 thereto.

The protrusion portion 130 is extended upward from the upper surface of the case 110. A hollow is formed in the protrusion portion 130 so that the terminal 150 is disposed. A step portion 121 may be formed on the upper surface of the case 110 to separate the housing 120 upwardly so that a separate plug to be coupled to the connector 200 can be easily coupled.

The mounting portion 140 is formed on one side of the protrusion portion 130. When the surface on which the mounting portion 140 is formed is referred to as a front surface, a terminal groove 142 recessed toward the rear is formed on the front surface of the mounting portion 140 so that the terminal 150 is exposed to the outside. Therefore, it is understood that the hollow formed inside the housing 120 is extended upward from the upper surface of the case 110 and communicates with the terminal groove 140.

Meanwhile, the material of the case 110 and the housing 120 may be plastic or resin.

One end 159*b* of the terminal 150 is electrically connected to the electronic component, and the other end 150*a* is exposed to the outside through the mounting groove 142. That is, it is understood that the other end 150*a* of the terminal 150 is protruded from the bottom surface of the mounting groove 142 and is exposed to the outside. A separate plug (not shown), which is in electrical contact with the terminal 150, is inserted into the mounting groove 142 so that it may provide a power to the electronic components or may receive and transmit a separate signal through electrical contact with the terminal 150.

As illustrated, the terminal 150 may be bent at least once. Since the mounting portion 140 is extended forward from the front surface of the protrusion portion 130, the terminal 150 can also be extended forward as a vertical end extending upward from the electronic component is being bent.

The terminal 150 may be provided in plurality. For example, the terminal 150 may comprise a power terminal 151 for supplying power to the electronic components, and a signal terminal 151 for transmitting and receiving signals to the electronic components. The power supply terminal 151 and the signal terminal 151 are spaced apart from each other and may be divided at the bottom surface of the mounting groove 150.

Hereinafter, the structure of the housing 120, which is an essential part of the present invention, will be described.

Figure 8:
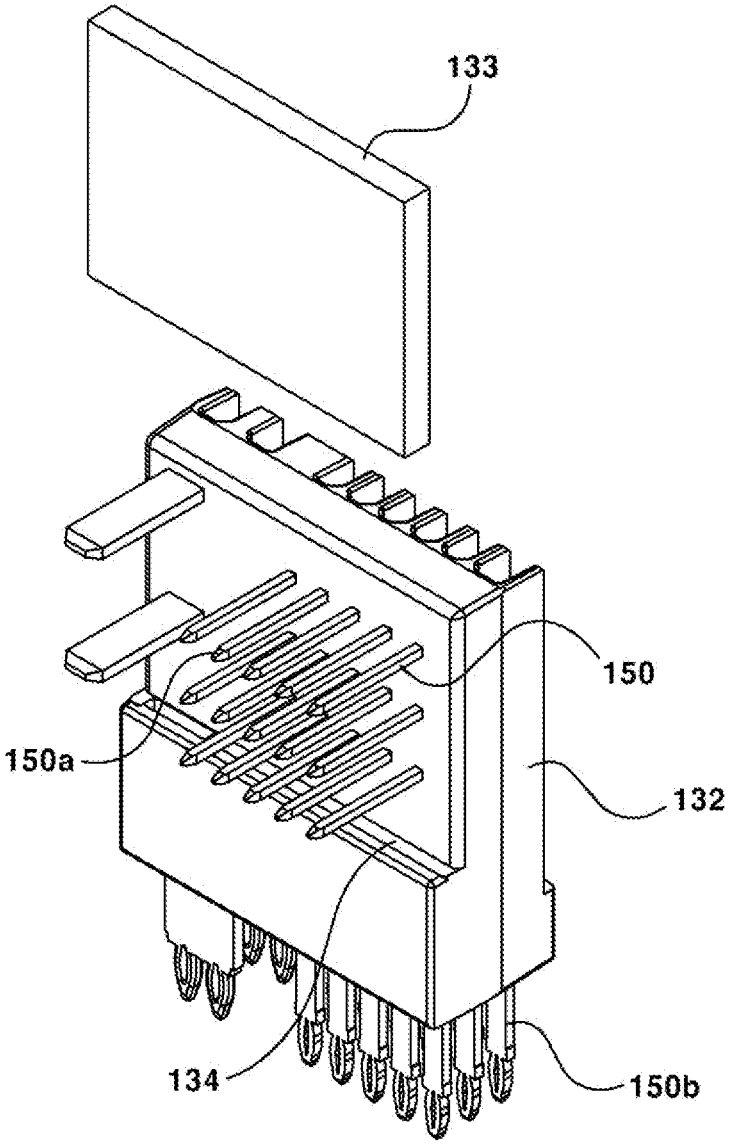
FIG. 8 is an exploded perspective view of the inner housing according to the second embodiment of the present invention.

FIG. 8 is an exploded perspective view of the inner housing according to the second embodiment of the present invention.

Referring to FIGS. 7 and 8, a separate inner housing 132 to which the terminal 150 is mounted may be disposed in the housing 120. The inner housing 132 is disposed in the hollow formed inside the housing 122 and supports the terminal 150.

In detail, the inner housing 132 may be disposed inside the protrusion portion 130 such the lower surface thereof faces the case 110 and the front surface thereof faces the mounting groove 142. It is therefore understood that one end 150*b* of the terminal 150 is protruded downward from the lower surface of the inner housing 132 and protruded forward from the front surface of the inner housing 132 of the other end 150*a*. For this, holes 132*a* and 132*b* may be formed on the front and bottom surfaces of the inner housing 132, respectively, to allow the terminal 150 to pass therethrough.

A pad seating portion 134 is formed on the front surface of the inner housing 132 so that the pad 133 is seated. The pad seating portion 134 may be formed such that a portion of the front surface of the inner housing 132 is recessed rearwardly to be stepped with respect to other regions. Meanwhile, the width of the pad seating portion 134 is formed corresponding to the width of the pad 133, so that when the pad 133 is attached to the pad seating portion 134, the front surface of the pad 133 the front surface of the inner housing 132 can form a sense of unity with each other.

The pad 133 is seated on the pad seating portion 134. A separate hole 132*a* may be formed in the pad 133 to allow the terminal 150 to pass therethrough. The hole 133*a* may be formed in advance at the time of manufacturing the pad 133, but hole 132*a* may also be formed when the terminal 150 is penetrating through the pad 133 during the process wherein the pad 133 is coupled to the pad seating portion 134.

In other words, since the terminal 150 is protruded from one surface of the pad 133, in other words, it can be understood that the pad 133 is disposed on the bottom surface of the mounting groove 142.

The position of the other end 150*a* of the terminal 150 protruding from the bottom surface of the mounting groove 142 can be firmly fixed by the pad 133 and the inner housing 132.

The material of the pad 133 may be an elastically deformable material. For example, the material of the pad 133 may be rubber or silicon.

Hereinafter, a manufacturing process of the connector 200 will be described.

Figure 9:
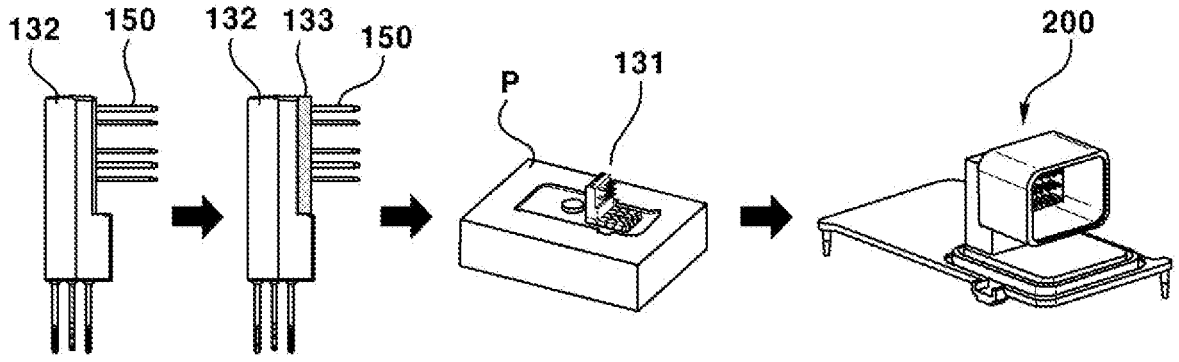
FIG. 9 is a view showing a manufacturing process of a connector according to a second embodiment of the present invention.

FIG. 9 is a view showing a manufacturing process of a connector according to a second embodiment of the present invention.

Referring to FIG. 9, the connector 200 according to the second embodiment of the present invention can be manufactured by a double injection molding process. The double injection molding is divided into a first injection molding process, which is a manufacturing process of the inner housing 132, and a second injection molding process, which is a manufacturing process of the connector 200 as a whole.

First, the terminal 150 is mounted on the inner housing 132 manufactured by the first injection molding process. One end 150*b* of the terminal 150 connected to the electronic component is extended downward from the lower surface of the inner housing 132 and the other end 150*a* exposed through the mounting groove 142, is extended forward from the front surface of the inner housing 132.

The pad 133 is seated on the pad seating portion 134. Therefore, since the other end 150*a* of the terminal 150 is supported while it is being inserted in the pad 133, the position can be firmly fixed.

Next, to form the entire housing 120 of the connector 200, the inner housing 132 having the pad 133 fitted therein is fixed to the mold P, and the raw material is injected and heated.

Conventionally, since the material of the housing and the terminal are different from each other, a gap is generated between the housing and the terminal during the injection molding process due to the different thermal expansion coefficient. As a result, there is a problem in that the bonding force between the terminal and the housing is poor, the product defect rate increases, and failures frequently occur.

According to the present embodiment, since the terminal 150 is firmly surrounded by the pad 133 even in a high-temperature and high-pressure injection molding process, there is an advantage in that the position between the terminal 150 and the inner housing 132 can be fixed. This is because, even if a part of the pad 133 is melted in a high temperature process, the terminal 150 is still wrapped in the process of cooling, so that the terminal 150 can be continuously aligned with the preset position.

Although not shown, the pad 133 may be coupled to the lower surface of the inner housing 132 in addition to the pad seating portion 134. The pad 133 is disposed on the front and bottom surfaces of the inner housing 132 where the terminals 150 are being protruded so that both ends of the terminals 150 is supported by the pad 133, and thus the position of the terminal 150 can be more firmly fixed.

Although the connector according to the first embodiment and the connector according to the second embodiment are described with different reference numerals, the scope of the present invention is not limited thereto, and the connector according to the first embodiment And the technical idea of the connector according to the second embodiment can be employed together in a single connector. For example, it is also included in the technical idea of the present invention that the housing having the heat radiation structure of the connector according to the first embodiment is provided with the pad and the pad seating portion arranged in the connector according to the second embodiment.

It should be noted that the exemplary embodiments disclosed in the drawings are merely examples of specific examples for the purpose of understanding, and are not intended to limit the scope of the present invention. It will be apparent to those skilled in the art that other modifications based on the technical spirit of the present invention are possible in addition to the exemplary embodiments disclosed herein.

The invention claimed is:

1. A connector which is disposed outside a case, the connector comprising:

a terminal including a first end disposed in the case and a second end disposed outside the case;

an inner housing coupled to the terminal such that the first end of the terminal protrudes from an outer surface thereof and the second end of the terminal protrudes from a protruding surface of the inner housing;

a pad having a first surface disposed on the protruding surface of the inner housing, a second surface that faces in a direction away from the first surface, and a bottom surface that is between the first surface and the second surface; and a housing surrounding the inner housing and surrounding the pad, wherein the housing comprises:

a protrusion portion protruding from one surface of the case; and a mounting portion having a terminal groove in which the pad and the second end of the terminal is provided;

wherein the inner housing includes a pad seating portion formed to be stepped with another area that is disposed on one surface of the inner housing, the pad is seated on the pad seating portion such that the bottom surface of the pad is coupled to the pad seating portion and the first surface of the pad contacts the protruding surface of the inner housing.

2. The connector according to claim 1, wherein material of the pad is an elastically deformable material.

3. The connector according to claim 1, wherein the second surface of the pad and the another area are aligned on a same plane.

4. The connector according to claim 3, wherein a width of the pad seating portion corresponds to a width of the pad.

5. The connector according to claim 1, wherein a separate pad is coupled to the lower surface of the inner housing.

6. The connector according to claim 1, wherein the inner housing and the housing are formed by separate injection molding processes.

7. The connector according to claim 6, wherein the inner housing coupled with the terminal is formed by a first injection molding process, and the housing is formed by a second injection molding process with the pad being coupled to the inner housing.

8. A connector which is disposed outside a case, the connector comprising:

a terminal including a first end disposed in the case and a second end disposed outside the case;

an inner housing coupled to the terminal such that the first end of the terminal protrudes from the inner housing and the second end of the terminal protrudes from a protruding surface of the inner housing;

a pad having a first surface facing the protruding surface of the inner housing, a second surface facing away from the inner housing, and a bottom surface; and a housing surrounding the inner housing and surrounding the pad, wherein the housing comprises:

a protrusion portion protruding from one surface of the case;

a mounting portion formed with a terminal groove wherein the second end of the terminal being protruded is disposed; and a discharge pipe communicating the inside and the outside of the case, wherein the inner housing includes a pad seating portion formed to be stepped with another area that is disposed on one surface of the inner housing, the pad is seated on the pad seating portion such that the bottom surface of the pad is coupled to the pad seating portion and the first surface of the pad faces the protruding surface of the inner housing.

9. The connector according to claim 8, wherein a discharge flow path of hollow shape is formed inside of the discharge pipe.

10. The connector according to claim 8, wherein a discharge hole communicating with the discharge path is formed on a bottom surface of the terminal groove.

11. The connector according to claim 10, further comprising a shielding film covering the discharge hole.

12. The connector according to claim 8, wherein the discharge pipe comprises:

a first discharge pipe extending upward from a lower surface of the case and disposed inside the protrusion portion; and a second discharge pipe extending from a bottom surface of the terminal groove and communicating with the first discharge pipe.

13. The connector according to claim 12, wherein the first discharge pipe is perpendicular to the second discharge pipe.

14. The connector according to claim 12, wherein the second discharge pipe is connected to a side surface which is a region between an upper end of the first discharge pipe and a lower end of the first discharge pipe.

15. The connector according to claim 8, wherein the protrusion portion and the mounting portion comprise a hollow in which the terminal is disposed.

16. The connector according to claim 8, wherein the terminal comprises:

a power supply terminal for supplying power to an electronic component, and a signal terminal for transmitting and receiving a signal of the electronic component, wherein a bottom surface of the terminal is provided with a partition wall that separates the power supply terminal from the signal terminal.

17. The connector according to claim 8, wherein material of the housing includes plastics and resins.

18. The connector according to claim 8, wherein a stepped portion for spacing the housing from the case is disposed on an outer surface of the case.

19. The connector according to claim 12, wherein a length of the first discharge pipe is longer than a length of the second discharge pipe.

20. The connector according to claim 16, wherein a mounting groove is provided with a partition for partitioning the power supply terminal and the signal terminal.

* * * * *